US008546716B2

(12) United States Patent
Nufer et al.

(10) Patent No.: US 8,546,716 B2
(45) Date of Patent: Oct. 1, 2013

(54) GAS-BLAST CIRCUIT BREAKER WITH A RADIAL FLOW OPENING

(75) Inventors: Juerg Nufer, Niederglatt (CH); Martin Kriegel, Unterehrendingen (CH); Olaf Hunger, Schaffhausen (CH); Marialuisa Perela, Zurich (CH)

(73) Assignee: ABB Technology AG, Zurich (CH)

( * ) Notice: Subject to any disclaimer, the term of this patent is extended or adjusted under 35 U.S.C. 154(b) by 563 days.

(21) Appl. No.: 12/491,863

(22) Filed: Jun. 25, 2009

(65) Prior Publication Data

US 2009/0261071 A1 Oct. 22, 2009

Related U.S. Application Data

(63) Continuation of application No. PCT/EP2007/064248, filed on Dec. 19, 2007.

(30) Foreign Application Priority Data

Dec. 27, 2006 (EP) ..... 06405545

(51) Int. Cl.
*H01H 33/88* (2006.01)

(52) U.S. Cl.
USPC ..... 218/43; 218/59

(58) Field of Classification Search
USPC ..... 218/43–48, 51–66, 88
See application file for complete search history.

(56) References Cited

U.S. PATENT DOCUMENTS

| | | | | |
|---|---|---|---|---|
| 4,598,188 | A | 7/1986 | Schötzau et al. | |
| 5,859,399 | A * | 1/1999 | Perret | 218/60 |
| 5,977,502 | A * | 11/1999 | Mizoguchi et al. | 218/43 |
| 6,207,917 | B1 | 3/2001 | Lehmann et al. | |
| 6,744,001 | B2 | 6/2004 | Dufournet et al. | |
| 2003/0173335 | A1 | 9/2003 | Dufournet et al. | |

FOREIGN PATENT DOCUMENTS

| | | | |
|---|---|---|---|
| DE | 603 05 552 | T2 | 4/2007 |
| EP | 0 146 671 | A1 | 7/1985 |
| EP | 0 296 363 | A2 | 12/1988 |
| FR | 2 694 987 | A1 | 2/1994 |
| WO | WO 98/43265 | A1 | 10/1998 |

OTHER PUBLICATIONS

Notification of Transmittal of Translation of the International Preliminary Report on Patentability and Written Opinion of the International Searching Authority (Forms PCT/IB/338, PCT/IB/373, and PCT/ISA/237) issued in corresponding International Patent Application No. PCT/EP2007/064248 dated Aug. 13, 2009, The International Bureau of WIPO, Geneva, Switzerland.

(Continued)

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

A gas-blast circuit breaker is disclosed which includes a first contact and a second contact which can move relative to one another along a longitudinal axis. A blowout volume is arranged around the first contact. The blowout volume can be connected via a gas channel to an arc zone, in order to blow out an arc which is struck when the first contact is disconnected from the second contact. The blowout volume can be bounded radially on an outside by a separating element which separates the blowout volume from a low-pressure area. A flow opening, which allows a gas exchange, can lead in a radial direction from the low-pressure area into the blowout volume.

27 Claims, 5 Drawing Sheets

(56) References Cited

OTHER PUBLICATIONS

Form PCT/ISA/210 (International Search Report) dated Jun. 25, 2008.

Non-English version of Form PCT/ISA/237 (Written Opinion of the International Searching Authority) dated Jun. 25, 2008.

European Search Report (with English Translation of Search Report Categories) dated Jun. 1, 2007.

* cited by examiner

GAS-BLAST CIRCUIT BREAKER WITH A RADIAL FLOW OPENING

RELATED APPLICATIONS

This application claims priority as a continuation application under 35 U.S.C. §120 to PCT/EP2007/064248, which was filed as an International Application on Dec. 19, 2007 designating the U.S., and which claims priority to European Application 06405545.2 filed in Europe on Dec. 27, 2006. The entire contents of these applications are hereby incorporated by reference in their entireties.

FIELD

The disclosure relates to the field of medium-voltage switch technology and high-voltage switch technology, such as circuit breakers in power distribution systems.

BACKGROUND INFORMATION

Circuit breakers such as gas-blast circuit breakers are known, for example, in high-voltage technology.

By way of example, WO 98/43265 discloses a gas-blast circuit breaker. The circuit breaker includes a first arc contact which can be driven, a second, stationary arc contact, a rated-current path which runs concentrically with respect to them, and a compression device in order to compress quenching gas in a blowout volume. The compressed quenching gas is used to quench an arc, which is created when the first arc contact is disconnected from the second arc contact, by blowing it out with quenching gas.

The first arc contact, which can be driven, is supported by a switching tube. An exhaust volume is provided at an outlet from this switching tube, into which the quenching gas is passed after blowing out the arc. The exhaust volume, which is arranged within the rated-current path, is connected to a low-pressure area outside the rated-current path, via blowout openings. Furthermore, the exhaust volume is separated by a separating wall from an induction area, which is arranged between the blowout volume and the exhaust volume, likewise within the rated-current path. This induction area is connected to the blowout volume via a purging valve and via an overpressure valve. The moving switching tube is passed through the separating wall, in a sealed manner.

With this known gas-blast circuit breaker, the gas pressure in the induction area can be maintained approximately constant such that the gas pressure in the exhaust volume does not influence the operation of the purging valve or the operation of the overpressure valve. However, the separating wall is arranged within the tubular rated-current path. Since the separating wall is subject to a high pressure difference between the induction area and the exhaust volume while the first arc contact is being disconnected from the second arc contact, the separating wall should be attached robustly to an inner wall of the rated-current path, and a sealed bushing is provided for the switching is tube through this separating wall.

A high-voltage circuit breaker is also known from US 2003/0173335 A1 (and DE 603 05 552 T2, which corresponds to this U.S. document). This known circuit breaker has an evacuation line between a thermal chamber and an expansion area, which evacuation line is arranged axially symmetrically with respect to the movement axis of the moving contacts. The evacuation line, which runs in the axial direction, is closed by a valve, which opens when the overpressure in the thermal arc quenching chamber is high.

EP 0 146 671 A1 discloses a further gas-blast circuit breaker. To keep a pressure in a piston volume from rising above a predetermined value during opening of the gas-blast circuit breaker, this gas-blast circuit breaker has a radially arranged overpressure valve in an effort to have gas flow away through this overpressure valve when the overpressure in the piston volume is excessive.

EP 0 296 363 A2 discloses a gas-blast circuit breaker with a quenching gas flow that is produced by the circuit breaker itself. This gas-blast circuit breaker has a compression area. To address an excessive pressure in the compression area, this gas-blast circuit breaker has a valve through which gas can flow out radially from the compression area.

SUMMARY

A gas-blast circuit breaker is disclosed comprising: a first contact; a second contact for making an electrically conductive connection to the first contact, with the first contact and the second contact being movable relative to one another along a longitudinal axis; a blowout volume, which is connected to an arc zone for receiving a pressure build-up and for blowing out an arc with quenching gas; an exhaust volume for receiving and cooling gas; a low-pressure area, which is separated by a separating element from the blowout volume and in which gas pressure is maintained approximately constant during a switching process; and a flow opening, which cannot be closed, for providing a gas exchange between the low-pressure area and the blowout volume through an area of the separating element which separates the blowout volume from the low-pressure area in a radial direction with respect to the longitudinal axis.

A gas-blast circuit breaker is disclosed comprising: a first contact; a second contact for making an electrically conductive connection to the first contact, with the first contact and the second contact being movable relative to one another along a longitudinal axis; a blowout volume, which is connected to an arc zone for receiving a pressure build-up and for blowing out an arc with quenching gas; an exhaust volume for receiving and cooling gas; a low-pressure area, which is separated by a separating element from the blowout volume and in which gas pressure is maintained approximately constant during a switching process; a flow opening for providing a gas exchange between the low-pressure area and the blowout volume though an area of the separating element which separates the blowout volume from the low-pressure area in a radial direction with respect to the longitudinal axis; and a purging valve formed as a non-return valve arranged in or on the flow opening.

BRIEF DESCRIPTION OF THE DRAWINGS

The subject matter of the disclosure will be explained in more detail in the following text with reference to exemplary embodiments, which are illustrated in the attached drawings, in which, purely schematically.

Figure 1:
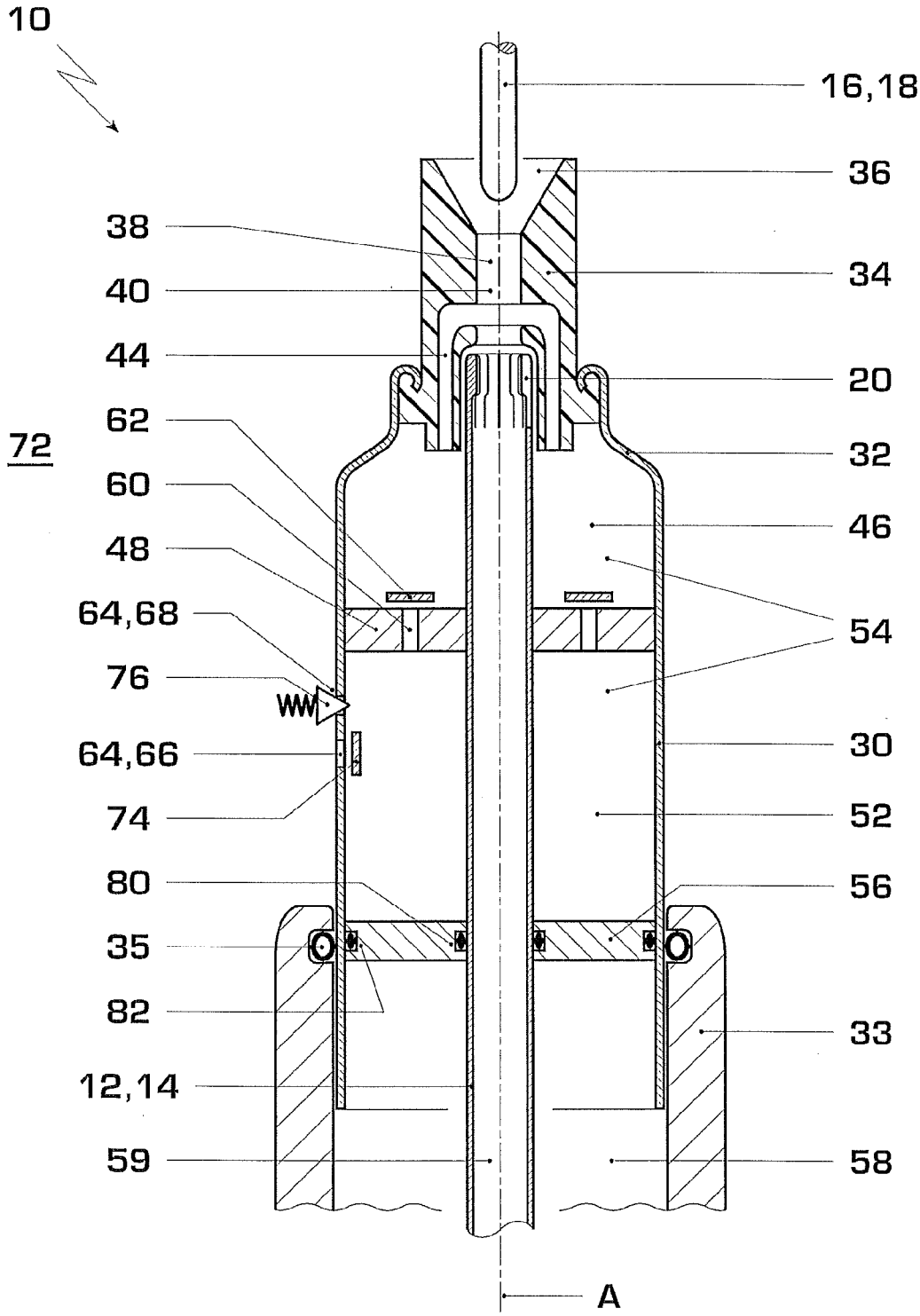
FIG. 1 shows an exemplary gas-blast circuit breaker according to the disclosure, such as a circuit breaker which has two flow openings between a low-pressure area and a compression area, in which one flow opening can be closed by a purging valve, and the other flow opening can be closed by an overpressure valve.

Reference symbols used in the figures, and their meanings, are listed in summary form in the list of reference symbols. In principle, identical parts or parts having the same effect are provided with the same or similar reference symbols in the figures. Some parts which are not essential for understanding the disclosure are not illustrated. The described exemplary embodiments represent examples of the subject matter of the disclosure, and have no restrictive effect.

DETAILED DESCRIPTION

An exemplary gas-blast circuit breaker is disclosed which can be of simpler design, and which allows a more compact design. An exemplary gas-blast circuit breaker according to the disclosure can be configured to be highly reliable.

An exemplary gas-blast circuit breaker according to the disclosure can include a flow opening, which cannot be closed and which allows a gas exchange between a low-pressure area and a blowout volume. The flow opening which cannot be closed runs through an area of a separating element which separates the blowout volume from the low-pressure area in the radial direction with respect to a longitudinal axis. In consequence, particularly when there is an excessive overpressure in the blowout volume, quenching gas can flow away out of the blowout volume into the low-pressure area. In consequence, the gas pressure in the blowout volume cannot rise indefinitely. Furthermore, this makes it possible to achieve a particularly simple gas-blast circuit breaker design.

According to an exemplary embodiment, the blowout volume is subdivided into a compression area and into a heating area, with the flow opening which cannot be closed opening into the compression area. This makes it possible to ensure that the pressure in the compression area cannot rise indefinitely and that unconsumed quenching gas can flow out of the compression area into the low-pressure area. Quenching gas can likewise also flow from the low-pressure area into the compression area.

According to an exemplary embodiment, the gas-blast circuit breaker has a further flow opening which can be closed, and which can be closed by means of a purging valve in the form of a non-return valve.

An exemplary gas-blast circuit breaker according to the disclosure can include a flow opening, which allows a gas exchange, between the low-pressure area and a blowout volume through an area of a separating element which separates the blowout volume from the low-pressure area in the radial direction with respect to the longitudinal axis of the gas-blast circuit breaker. According to the disclosure, a purging valve is arranged in or on the flow opening. This makes it possible to ensure that, in order to fill the blowout volume with quenching gas, this quenching gas can flow out of the low-pressure area into the blowout volume or into the compression area, but not in the opposite direction. Since the gas pressure on the side of the low-pressure area is, furthermore, at least approximately constant (e.g., ±10% or lesser or greater), the purging valve opens at a predetermined pressure, irrespective of the pressure profile during the switching process.

By way of example, the blowout volume of the gas-blast circuit breaker is connected via a channel to an arc zone of the gas-blast circuit breaker, through which quenching gas which has been heated during a first phase of a disconnection process, for example $SF_6$, (sulfur hexafluoride) passes from the arc zone into the blowout volume. For a further phase, which follows this, quenching gas flows out of the blowout volume through the channel to the arc zone, in order to blow out an arc that is burning there. The quenching gas then flows away further into an exhaust volume.

The flow opening and the purging valve make it possible to ensure that quenching gas can flow out of the low-pressure area into the blowout volume. The routing according to the disclosure of the flow opening in the radial direction allows the gas-blast circuit breaker to be designed to be compact in the longitudinal direction. Furthermore, this connection of the low-pressure area to the blowout volume can be advantageous since the pressure in the low-pressure area is, for example, at least approximately constant at any time during the switching process, and the quenching gas in the low-pressure area is not ionized and is cool.

According to an exemplary embodiment, the purging valve and an overpressure valve are arranged in or on the same flow opening. This allows the gas-blast circuit breaker to be designed to be particularly compact, while also allowing simple final assembly of the gas-blast circuit breaker. For example, the purging valve and the overpressure valve can be assembled in advance, as a unit.

According to an exemplary embodiment, the gas-blast circuit breaker can have a further flow opening, which can be closed by means of an overpressure valve. This makes it possible to ensure that quenching gas can flow away into the low-pressure area at a predetermined overpressure in the compression area or in the blowout volume. Since the gas pressure in the low-pressure area is at least approximately constant, the overpressure valve opens at a predetermined response pressure. This makes it possible to ensure that no impermissibly high pressure builds up in the compression area or in the blowout volume. This makes it possible to prevent the operation of the gas-blast circuit breaker being adversely affected as a result of an excessively high gas pressure in the compression area or in the blowout volume.

According to an exemplary embodiment, the blowout volume can be subdivided into a compression area and into a heating area, with the flow opening opening into the compression area. This makes it possible to ensure that unconsumed quenching gas can flow through the purging valve from the low-pressure area into the compression area and through the overpressure valve from the compression area into the low-pressure area.

According to an exemplary embodiment, the gas-blast circuit breaker can have a purging channel, which can be closed by a non-return valve, between the compression area and the exhaust volume. Furthermore, the gas-blast circuit breaker has the flow opening, in particular the flow opening which cannot be closed, between the low-pressure area and the blowout volume or the compression area. The flow opening forms a type of overpressure valve in a very simple manner, with the flow opening always being open, when it is not closed by a valve. The choice of the geometry of the flow opening allows a gas flowthrough is to be controlled.

FIG. 1 shows an exemplary gas-blast circuit breaker, such as a circuit breaker, according to a first exemplary embodiment of the disclosure. Gas-blast circuit breakers such as these are used, for example, in high-voltage switchgear assemblies.

The gas-blast circuit breaker 10 has a first contact 14, which is in the form of a tube 12 and is intended to interact with a second contact 18, which is in the form of a pin 16. The first contact 14 and the second contact 18 can be manufactured at least at their free end areas from an erosion-resistant material, such as from tungsten and copper. The tube 12 and the pin 16 are arranged on a common longitudinal axis A, and can move relative to one another. In the exemplary embodiment shown in FIG. 1, the first contact 14 is designed to be moveable. The associated drive arrangement is not illustrated.

The free end area 20 of the first contact 14 can be in the form of a contact tulip with a plurality of contact fingers, in a known manner. The free end areas of the contact fingers can, for example, be manufactured from the erosion-resistant material.

A separating element 30 with a hollow cylindrical shape is arranged around the first contact 14, with one end area 32 of this separating element 30 tapering. The free end of the tapered end area 32 can be aligned with the free end of the first contact 14 in the direction of the longitudinal axis A. In the circumferential direction, a stationary conductor element 33 clasps the other end area of the separating element 30, which is opposite the tapering end area 32 in the direction of the longitudinal axis A. A conductive connection is produced between the conductor element 33 and the separating element 30, which can move relative to the conductor element 33, by means of a contact spring 35. Instead of being produced via a contact spring, the contact can also be produced, for example, via a sliding contact, a spiral contact, a sliding tulip or a rolling contact. This is inserted into a circumferential groove which is formed radially on the inside in the free end area of the conductor element 33.

The separating element 30 is part of a rated-current contact arrangement, which is known and is not shown in the figures. The separating element 30 forms a first rated-current contact, and is electrically connected to the first contact 14. The second contact 18 is electrically conductively connected to a second rated-current contact, which is intended to interact with the first rated-current contact, the separating element 30, when the gas-blast circuit breaker is closed.

A nozzle body 34 is arranged in the tapered end area 32 of the separating element 30, with the nozzle body 34 projecting out of the separating element 30 in the direction of the longitudinal axis A. The nozzle body 34 is, for example, manufactured from an insulating material, for example polytetrafluoroethylene. From the end which projects out of the separating element 30, the nozzle body 34 first of all has a nozzle opening 36 which tapers in the direction of the longitudinal axis A toward the first contact 14, and merges into a nozzle channel 38. On the side opposite the nozzle opening 36, the nozzle channel 38 widens to an internal diameter which is greater than the external diameter of the contact tulip of the first contact 14, with the internal diameter being chosen such that the contact fingers of the contact tulip have a sufficiently large amount of play. The area within the nozzle body 34, which is located between the contact tulip and the free end, forms an arc zone 40.

A gas channel 44 opens into the nozzle channel 38 and connects the arc zone 40 to a heating area 46 in the interior of the separating element 30. This gas channel 44 is intended on the one hand to pass quenching gas, which is heated by an arc, from the arc zone 40 into the heating area 46. On the other hand, the gas channel 44 is intended to pass quenching gas from the heating area 46 into the arc zone 40 in order to blow out the arc which is burning in the arc zone 40. The heating area 46 can have a constant volume.

The heating area 46 is bounded in the radial direction by the separating element 30. The heating area is likewise bounded by the separating element 30, and by the nozzle body 34 as well, in the direction of the nozzle opening 36. In the opposite direction to the nozzle opening 36, the heating area 46 is bounded by an intermediate element 48, which is like an intermediate wall. The first contact element 14 is passed through the intermediate element 48 in a sealed manner. The intermediate element 48 is, for example, held on the separating element 30 in an interlocking manner. It can likewise be attached to the first contact 14 in an interlocking manner.

The intermediate element 48 subdivides an internal area of the separating element 30 into the heating area 46 and a compression area 52. The interior of the separating element 30—the heating area 46 and the compression area 52—together form a blowout volume 54. The compression area 52 is bounded on the side opposite the intermediate element 48 by a piston 56, which in an exemplary case is arranged in a fixed position. The piston 56 is part of a cylinder/piston arrangement, with the cavity in this cylinder/piston arrangement being formed by the compression area 52.

The piston 56 has a flow opening for the first contact 14 to pass through. A seal 80 is inserted between the piston 56 and the first contact 14 into a groove which is circumferential in the piston, in order to seal a gap between the first contact 14 and the piston 56. Furthermore, the seal 80 also forms a guide for the first contact 14. The piston 56 is sealed with respect to the separating element 30 by means of a further seal 82, which is inserted into a further circumferential groove in the piston 56.

An exhaust volume 58 is located within the conductor element 33 on the side of the piston 56 opposite the compression area 52. This exhaust volume 58 is connected through a flow channel 59, which is formed in the tube 12, to the arc zone 40, as a result of which quenching gas which flows out of the heating area 46 through the gas channel 44 into the arc zone 40 can flow away through the flow channel 59 into the exhaust volume 58. During a high-current phase, quenching gas could also flow directly from the arc zone 40 into the exhaust volume 58.

A channel 60 leads through the intermediate element 48 from the compression area 52 into the heating area 46 and can be closed by an intermediate valve 62, which is in the form of a non-return valve, such that quenching gas flows from the compression area 52 into the heating area 46 when the pressure in the compression area 52 is higher than that in the heating area 46. When the pressure in the heating area 46 is higher than that in the compression area 52, the intermediate valve 62 closes.

In the radial direction, there is a purging aperture 66 which forms a flow opening 64 and an overpressure aperture 68 which likewise forms a flow opening 64 from the compression area 52 into a low-pressure area 72, which is radially externally adjacent to the separating element 30. The low-pressure area 72 surrounds the rated-current contact arrangement. During a switching process of the gas-blast circuit breaker 10, the gas pressure in the low-pressure area 72 is at least approximately constant, and is, for example, in the range of from 3-7 bar.

The low-pressure area 72 is bounded by a casing of the gas-blast circuit breaker, which is connected to the exhaust volume 58 via a gas return.

According to an exemplary embodiment, the purging aperture 66 can be closed by means of a purging valve 74, which is in the form of a non-return valve, such that the purging valve 74 opens when the pressure in the compression area 52 is lower than that in the low-pressure area 72, and is otherwise closed.

The overpressure aperture 68 can be closed by means of an overpressure valve 76 which opens when the pressure in the compression area 52 is higher than that in the low-pressure area 72 by a defined amount, in order to dissipate any overpressure in the compression area 52.

A plurality of purging apertures 66 may, of course, also be provided, each of which can be closed by means of a purging valve 74. A plurality of overpressure apertures 68 can likewise be provided, each of which can be closed by means of an overpressure valve 76.

The gas-blast circuit breaker shown in FIG. 1 can operate in an exemplary manner as follows. First of all, the rated-current contact arrangement is opened. The contact arrangement formed by the first contact 14 and the second contact 18 is then disconnected, as a result of which an arc is struck in the arc zone 40, because of the current flowing through the contact arrangement. Quenching gas is thus heated and initially flows through the gas channel 44 into the heating area 46. When the contact arrangement opens, the size of the compression area 52 is also reduced by the movement of the separating element 30 together with the first contact 14 in the direction of the longitudinal axis A away from the second contact 18, as a result of which the gas pressure in the compression area 52 rises. When the gas pressure in the compression area 52 is greater than that in the heating area 46, the intermediate valve 62 opens, as a result of which quenching gas flows through the channel 60 out of the compression area 52 into the heating area 46, in which the gas pressure is increased further. As soon as the gas pressure in the arc zone 40 decreases, quenching gas flows out of the heating area 46 through the gas channel 44 into the arc zone 40, and blows out the arc, which is thus quenched.

However, if the gas pressure in the heating area 46 rises rapidly to a high value, because of a high current flow, initiated by a ground fault by way of example, the situation can occur in which the intermediate valve 62 remains closed in the heating area 46 during the disconnection process of the contact arrangement, or is closed at least for a relatively long time period during the disconnection process. The quenching gas therefore cannot flow out of the compression area 52 into the heating area 46. When a predetermined gas pressure is reached in the compression volume 52, the overpressure valve 76 now opens, as a result of which quenching gas can flow away through the overpressure aperture 68 into the low-pressure area 72. Since the gas pressure in the low-pressure area 72 is at least virtually constant, for example, during the disconnection process, the maximum pressure in the compression area 52 is defined by the response pressure of the overpressure valve 76. This makes it possible to ensure that the force which is used to open the contact arrangement, for example, to move the separating element 30 together with the first contact 14 into the conductor element 33, does not exceed a maximum force. The drive arrangement can therefore be designed such that the contact arrangement can be reliably disconnected even when the current flow is high.

The quenching gas which is used to blow out the arc in the arc zone 40 flows away on the one hand through the flow channel 59 into the exhaust volume 58, and on the other hand through the nozzle opening 36. The hot quenching gas is cooled in the exhaust volume 58. A gas exchange can take place between the exhaust volume 58 and the low-pressure area 72 via a gas return.

When the contact arrangement closes, the volume of the compression area 52 increases, thus resulting in the pressure in the compression area 52 being lower than that in the low-pressure area 72 and in the heating area 46. In consequence, the purging valve 74 according to the disclosure opens, releasing the purging aperture 66 to allow quenching gas to flow out of the low-pressure area 72 into the compression area 52. As soon as the gas pressure in the compression volume 52 rises above the gas pressure in the low-pressure area 72, the purging valve 74 closes. The flow of the quenching gas out of the low-pressure area 72 into the blowout volume 54, for example, into the compression area 52, can ensure that cold quenching gas flows into the blowout volume 54 and into the compression area 52 even shortly after the opening of the gas-blast circuit breaker. This makes it possible to ensure that the gas-blast circuit breaker operates reliably even in the event of disconnection processes being carried out shortly one after another in it.

Figure 6:
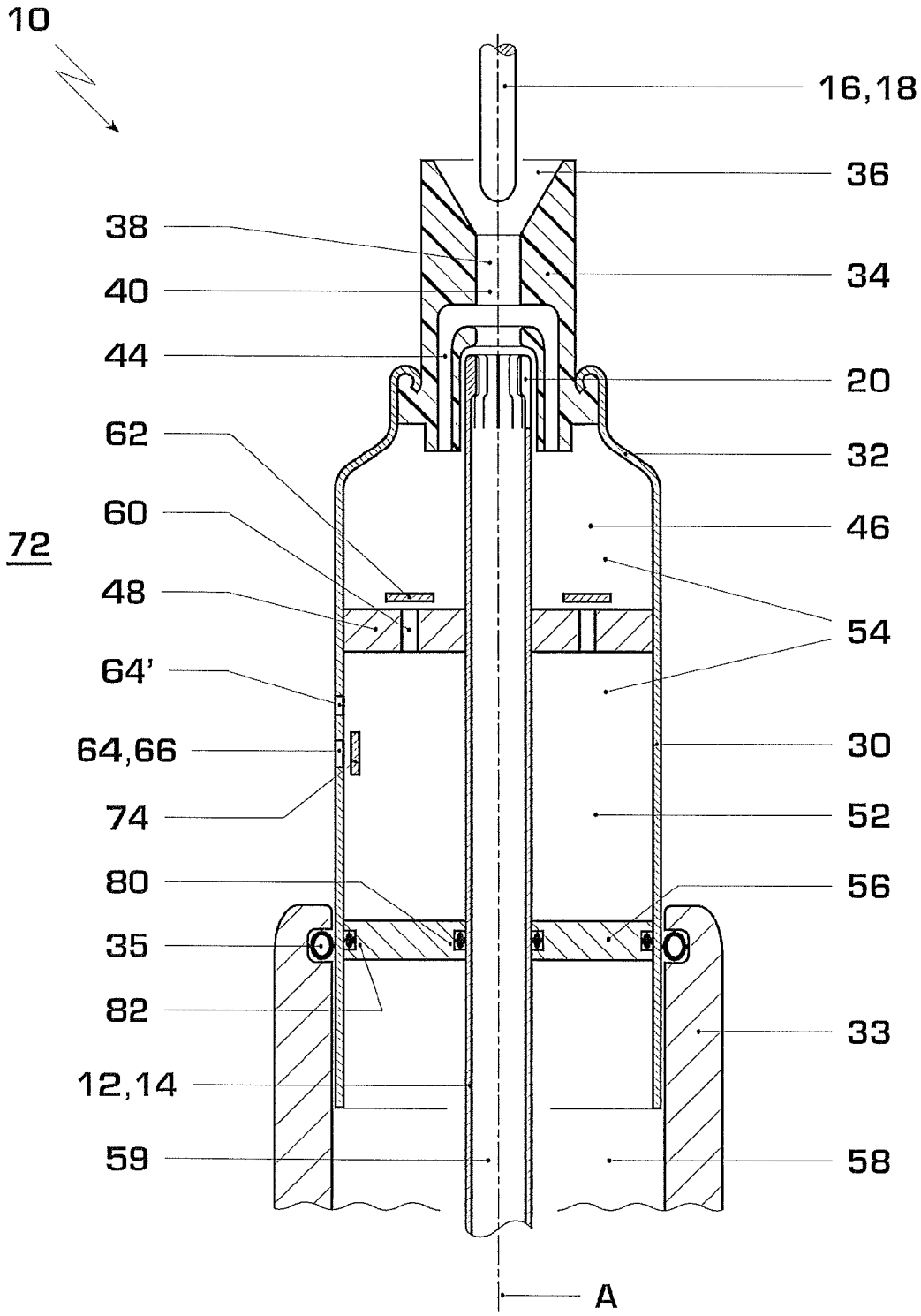
FIG. 6 shows an exemplary gas-blast circuit breaker according to the disclosure, such as a circuit breaker, which has two flow openings between a low-pressure area and a compression area, in which one flow opening can be closed by a purging valve and the other flow opening cannot be closed.

In an exemplary embodiment, which is shown in FIG. 6 and is described in detail in conjunction with FIG. 6, the overpressure valve 76 at the overpressure aperture 68 is dispensed with. Nevertheless, the quenching gas flow through the overpressure aperture 68, for example, when the pressure in the compression area 52 is higher than that in the low-pressure area 72, can be controlled by the unobstructed diameter of the overpressure aperture 68. In consequence, quenching gas can flow out of the compression area 52 into the low-pressure area 72 on disconnection of the first contact 14 from the second contact 18, with the volume of the compression area 52 being reduced at the same time. In consequence, the gas pressure in the compression area 52 cannot rise indefinitely.

Figure 2:
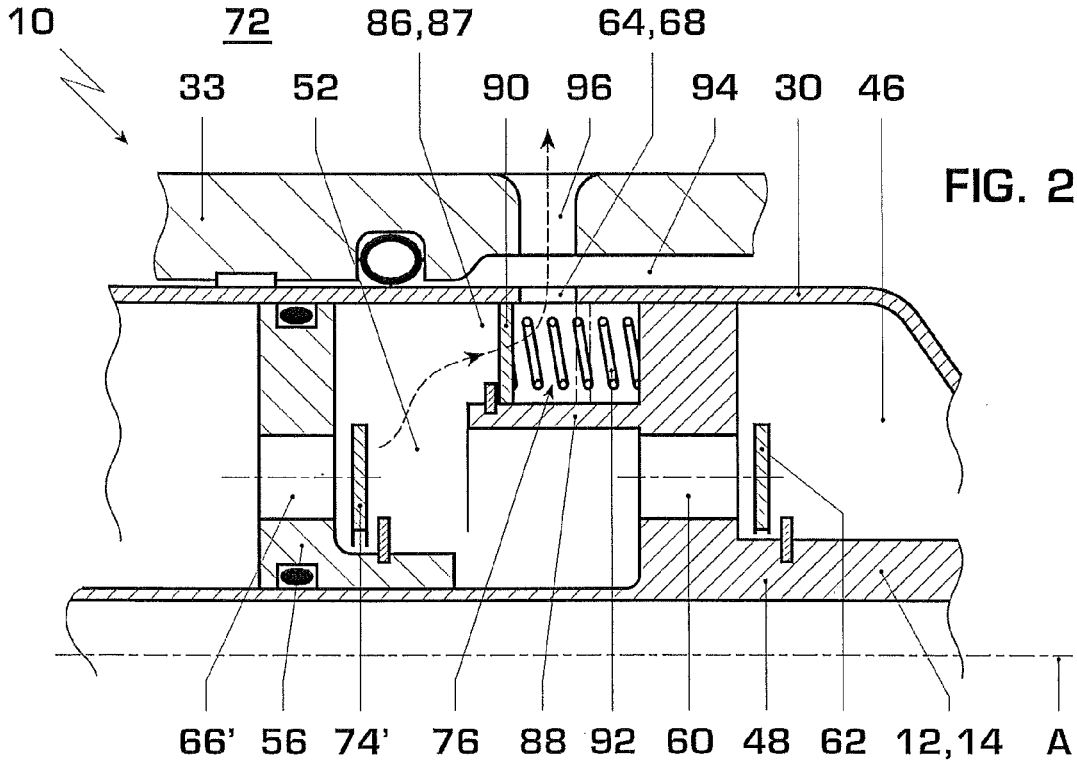
FIG. 2 shows a partial view of an exemplary gas-blast circuit breaker which has an overpressure valve in order to close a flow opening, which is formed between the low-pressure area and the compression area, which overpressure valve is formed in an assembly with an intermediate valve, which is in the form of a non-return valve, between the heating area and the compression area.

FIG. 2 shows a further example of a gas-blast circuit breaker. This exemplary embodiment corresponds essentially to the gas-blast circuit breaker 10 illustrated in FIG. 1. Only the differences will be described here.

In this embodiment, the separating element 30 has only the flow opening 64, which forms the overpressure aperture 68 and can be closed by means of the overpressure valve 76. The separating element 30 can, for example, have a plurality of overpressure apertures 68 which can be closed by means of one of more overpressure valves 76. Between 4-8 overpressure apertures 68 are, for example, formed on the separating element 30. The overpressure apertures 68 can also be in the form of slots.

The intermediate element 48 illustrated in FIG. 2 can be formed integrally with the tube 12 of the first contact 14. The intermediate piece and the tube 12 may, of course, also be formed from a plurality of individual elements.

In order to form the overpressure valve 76, the intermediate element 48 has an annular channel 86 which is open in the direction of the piston 56 and into which the overpressure aperture 68 opens in the radial direction. Together with the overpressure aperture 68, the annular channel forms a connecting channel 87. The annular channel 86 is bounded in the radial direction on the one hand by a wall 88 which is formed on the intermediate element 48, and on the other hand by the separating element 30. An annular disk 90, which is mounted such that it can move in the direction of the longitudinal axis A, is arranged as a valve disk in the annular channel 86. Springs 92 press this annular disk 90 in the direction of the opening of the annular channel 86, with a stop restricting the freedom of movement of the annular disk in the direction of the opening.

The overpressure valve 76 can, for example, operate as follows. When an overpressure occurs in the compression area 52, the connecting channel 87 which is connected to the overpressure aperture 68 is closed by the annular disk 90 which is located between the separating element 30 and the wall 88. As soon as the gas pressure in the compression area 52 rises above the response pressure of the overpressure valve 76, which is defined by the springs 92, the annular disk 90 moves in the axial direction A into the annular channel, to the position indicated by dashed lines in FIG. 2. When the annular disk 90 is in this position, the overpressure valve 76 is opened, and the quenching gas can flow without any impediment out through the connecting channel 87 and the overpressure aperture 68 adjacent to it.

The piston 56 has a purging aperture 66' which, in a corresponding manner to the purging aperture 66 described in conjunction with FIG. 1, can be closed by means of a purging valve 74', which is in the form of a non-return valve. The purging aperture 66 leads from the exhaust volume 58 into the compression area 52.

The channel 60 passes through the intermediate element 48, which is arranged at the first contact 14, in the direction of the longitudinal axis A. The intermediate element 48 preferably has a plurality of channels 60 which are arranged regularly in the circumferential direction. The channel 60 or the channels 60 can be closed by means of a valve plate of the intermediate valve 62. The valve plate is, for example, once again in the form of a circular annular disk.

The conductor element 33 can be longer in the direction of the longitudinal axis A than that in the exemplary embodiment shown in FIG. 1. An intermediate area 94 is formed between the separating element 30 and the lengthened section of the separating element 30. The overpressure aperture 68 opens into this intermediate area 94. A channel 96 leads from the intermediate area 94 into the low-pressure area 72.

Figure 3:
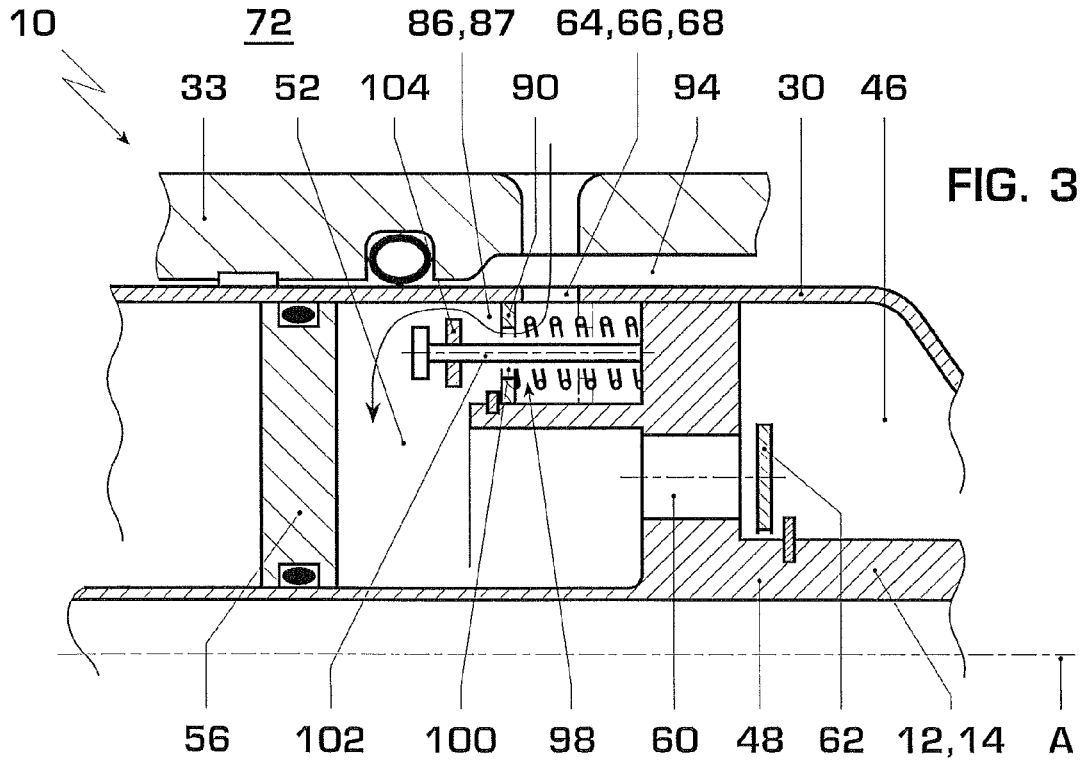
FIG. 3 shows a partial view of an exemplary gas-blast circuit breaker according to the disclosure, in which the overpressure valve is combined with a purging valve according to the disclosure in a dual-acting valve in order to close the flow opening, as shown in FIG. 2, between the compression area and the low-pressure area.

FIG. 3 illustrates a third exemplary embodiment. Reference is made to the description relating to FIG. 2 for those elements illustrated in FIG. 3 which have already been described in conjunction with FIG. 2. Identical parts or parts having the same effect are provided with the same reference symbols.

In this exemplary embodiment, the overpressure aperture 68 likewise forms the purging aperture 66, that is to say the purging aperture 66 and the overpressure aperture 68 are formed as a common flow opening 64. In this exemplary embodiment, the purging aperture as described in conjunction with FIG. 2, through the piston 56, is dispensed with.

The flow opening 64 can be closed by a dual-acting valve 98. This dual-acting valve 98 opens when the pressure in the compression area 52 is lower than that in the low-pressure area 72, and in consequence acts as a purging valve. When the pressure in the compression area 52 is higher than that in the low-pressure area 72, the dual-acting valve 98 acts as an overpressure valve, with the dual-acting valve 98 opening only at a defined response pressure. This allows a gas flow from the compression area 52 into the low-pressure area 72.

The dual-acting valve 98 can, for example, be designed as follows. The intermediate element 48 is designed in the same way as the intermediate element as described in conjunction with FIG. 2 with the open annular channel 86. The flow opening 64 opens into this and, together with the annular channel 86, forms the connecting channel 87. A plurality of flow openings may, of course, also open into the annular channel 86. The annular disk 90, which is mounted such that it can move in the direction of the longitudinal axis A, is arranged in the annular channel 86 and is pressed by springs in the direction of the opening in the annular channel 86, with a stop restricting the freedom of movement of the annular disk 90 in the direction of the opening in the annular channel 86. Together with the spring and the stop for the annular disk 90, the annular disk 90 forms the overpressure valve of the dual-acting valve 98. The annular disk 90 has a plurality of holes 100, which are at a distance from the rim of the annular disk 90 and through each of which a guide element 102, which runs in the direction of the longitudinal axis A, is passed. The guide element 102 is firmly connected to the intermediate element 48. A stop for a valve plate 104 is formed at the free end of the guide element 102. This valve plate 104 can move freely between the stop and the annular disk 90 on the guide element 102 and forms the purging valve of the dual-acting valve 98.

The dual-acting valve 98 operates as follows. When there is an overpressure in the compression area 52, the connecting channel 87 is closed by the annular disk 90, which is located between the separating element 30 and the wall 88. The holes 100 in the annular disk are closed by the valve plate 104. As soon as the gas pressure in the compression area 52 rises above the response pressure, as defined by the springs 92, of the dual-acting valve 98, which acts as an overpressure valve, the annular disk 90 is moved together with the valve disks 104 in the axial direction A into the annular channel, to the position indicated by dashed lines in FIG. 2. When the annular disk 90 and the valve disks 104 are in this position, quenching gas can flow away out of the compression area 52 through the connecting channel 87 into the low-pressure area 72.

When the pressure in the compression area 52 is lower than that in the low-pressure area 72 (this situation is illustrated in FIG. 3), the dual-action valve 98 opens by the valve disks 104 being moved away from the annular disk by the pressure difference. The holes 100 in the annular disk are thus released, thus allowing quenching gas to flow into the compression area 52 from the low-pressure area 72.

Figure 4:
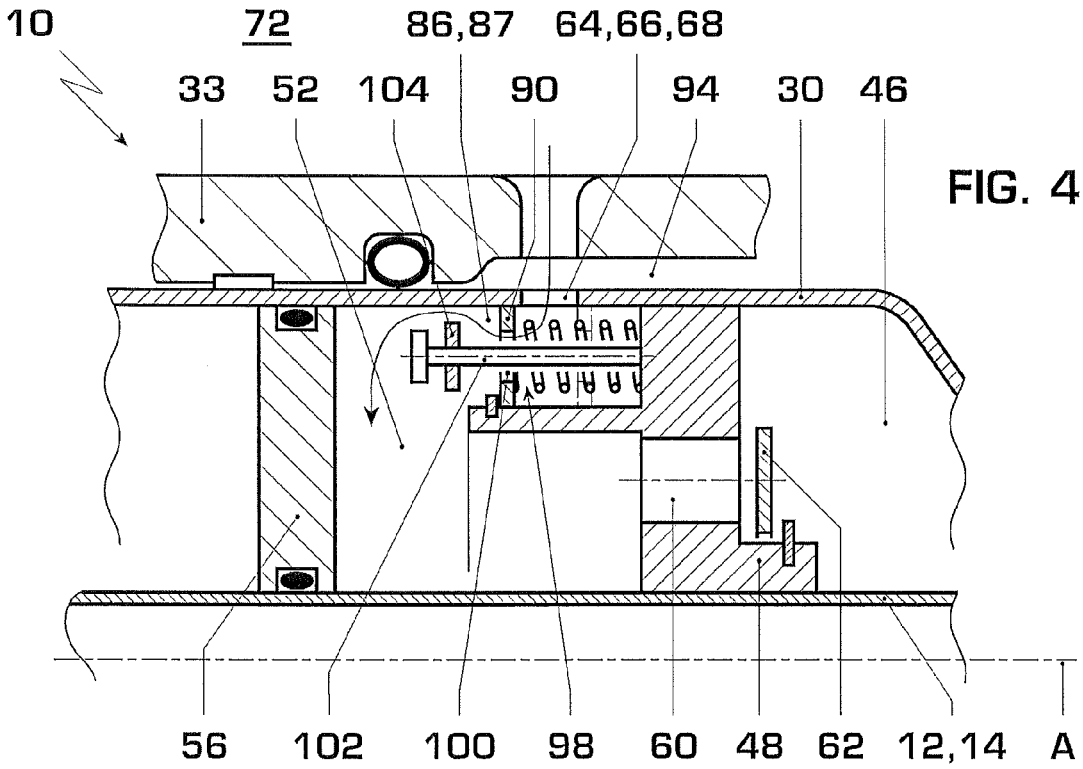
FIG. 4 shows a partial view of an exemplary gas-blast circuit breaker according to the disclosure.

As shown in FIG. 4, the intermediate element 48 is, for example, in the form of a prefabricated assembly, which is inserted into the separating element 30 and surrounds the first contact 14. The purging valve 74, which is shown in FIG. 1, the overpressure valve 68, which is in the form of a non-return valve, and the intermediate valve 62 are, for example, formed on the intermediate element 48. This can result in the gas-blast circuit breaker being particularly compact. Furthermore, this can considerably simplify the assembly of the gas-blast circuit breaker, thanks to the intermediate element 48. In FIG. 4, the purging valve and the overpressure valve can be in the form of a dual-action valve 98, as described in conjunction with FIG. 3.

Figure 5:
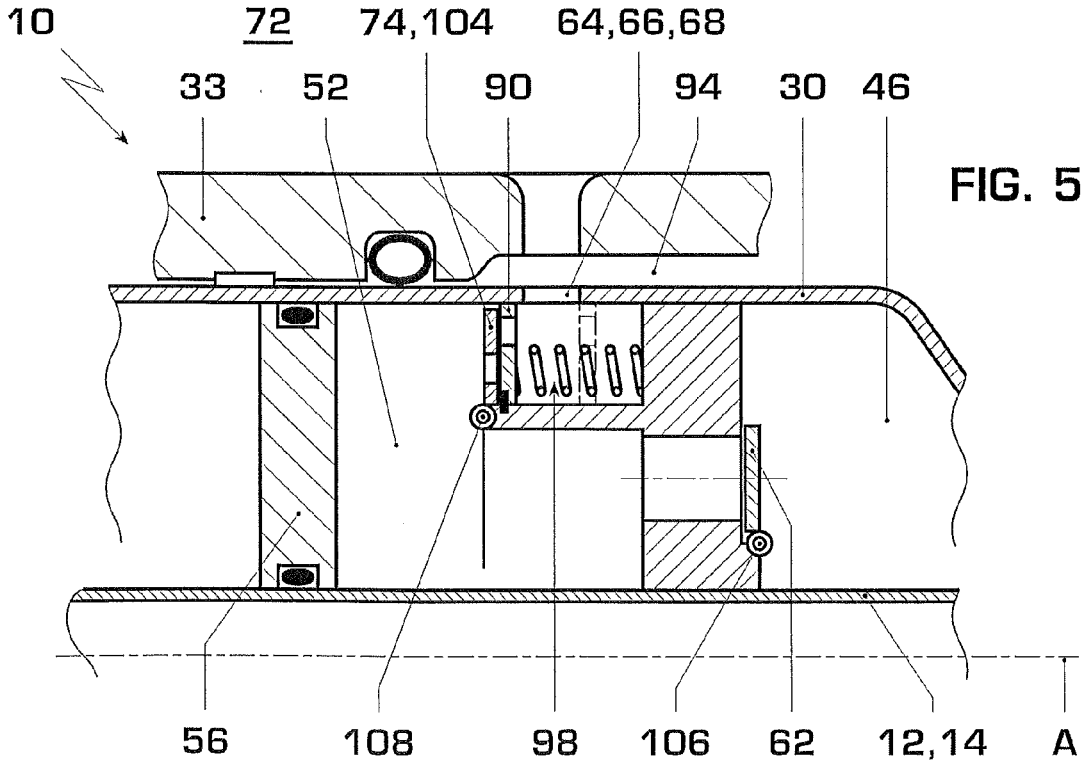
FIG. 5 shows a partial view of an exemplary gas-blast circuit breaker according to the disclosure.

In a fifth exemplary embodiment, which is illustrated in FIG. 5 and is largely the same as the exemplary embodiment shown in FIG. 4, the axially moveable circular annular disk of the intermediate valve 62 and the valve plate 104, which can likewise be moved axially, of the part of the dual-action valve 98 which forms the purging valve 74 are formed by flaps which can pivot about shafts 106, 108, instead of disks which can be moved in the direction of the longitudinal axis A, with the shaft 106 being associated with the intermediate valve 62 and the shaft 108 being associated with that part of the dual-action valve 98 which forms the purging valve 74. A plurality of flaps are, for example, used, in each case in the circumferential direction, for the intermediate valve 62 and for the purging valve 74.

FIG. 6 shows a gas-blast circuit breaker, for example, for a circuit breaker, according to a sixth exemplary embodiment. Gas-blast circuit breakers such as these are used, for example, in high-voltage switchgear assemblies.

The gas-blast circuit breaker 10 has a first contact 14, which is in the form of a tube 12 and is intended to interact with a second contact 18, which is in the form of a pin 16. The first contact 14 and the second contact 18 are, for example, manufactured, at least at their free end areas, from an erosion-resistant material, such as from tungsten and copper. The tube 12 and the pin 16 are arranged on a common longitudinal axis A and move relative to one another. In the exemplary embodiment shown in FIG. 6, the first contact 14 is moveable. The associated drive arrangement is not shown.

The free end area 20 of the first contact 14 is in the form of a contact tulip with a plurality of contact fingers, in a known manner. The free end areas of the contact fingers are, for example, manufactured from erosion-resistant material.

A separating element 30, which has a hollow-cylindrical shape, is arranged around the first contact 14, with the end area 32 of this separating element 30 tapering. The free end of the tapered end area 32 is aligned essentially with the free end of the first contact 14, in the direction of the longitudinal axis A. In the circumferential direction, a stationary conductive element 33 clasps the other end area of the separating element 30, which is opposite the tapering end area 32 in the direction of the longitudinal axis A. A conductive connection is produced between the conductor element 33 and the separating element 30, which can move relative to the conductor element 33, by means of a contact spring 35. Instead of being produced by means of a contact spring, the contact can also be produced, for example, by means of a sliding contact, a spiral contact, a sliding tulip or a rolling contact. This contact spring 35 is inserted into a circumferential groove which is formed radially on the inside in the free end area of the conductor element 33.

The separating element 30 is part of a rated-current contact arrangement, which is known but is not shown in the figures. The separating element 30 forms a first rated-current contact and is electrically connected to the first contact 14. The second contact 18 is electrically conductively connected to a second rated-current contact, which is not shown, and is intended to interact with the first rated-current contact, the separating element 30, when the gas-blast circuit breaker is closed.

A nozzle body 34 is arranged in the tapered end area 32 of the separating element 30, with the nozzle body 34 projecting out of the separating element 30 in the direction of the longitudinal axis A. The nozzle body 34 is, for example, manufactured from an insulating material, for example polytetrafluoroethylene. Starting from the end projecting from the separating element 30, the nozzle body 34 first of all has a nozzle opening 36, which tapers in the direction of the longitudinal axis A toward the first contact 14 and merges into a nozzle channel 38. On the side opposite the nozzle opening 36, the nozzle channel 38 widens to an internal diameter which is greater than an external diameter of the contact tulip of the first contact 14, with the internal diameter being chosen such that the contact fingers of the contact tulip have a sufficiently large amount of play. The area within the nozzle body 34, which is located between the contact tulip and the free end, forms an arc zone 40.

A gas channel 44 opens into the nozzle channel 38 and connects the arc zone 40 to a heating area 46 in the interior of the separating element 30. On the one hand, this gas channel 44 is intended to pass quenching gas, which is heated by an arc, from the arc zone 40 into the heating area 46. On the other hand, the gas channel 44 is intended to pass quenching gas from the heating area 46 into the arc zone 40, in order to blow out the arc that is burning in the arc zone 40. The heating area 46 can have a constant volume.

The heating area 46 is bounded in the radial direction by the separating element 30. In the direction of the nozzle opening 36, the heating area 46 is likewise bounded by the separating element 30, and by the nozzle body 34. In the opposite direction to the nozzle opening 36, the heating area 46 is bounded by an intermediate element 48 like an intermediate wall. The first contact element 14 is passed through the intermediate element 48 in a sealed manner. The intermediate element 48 is, for example, held in an interlocking manner on the separating element 30. It can likewise be attached to the first contact 14 in an interlocking manner.

The intermediate element 48 subdivides the internal area of the separating element 30 into the heating area 46 and a compression area 52. The interior of the separating element 30—the heating area 46 and the compression area 52—together form a blowout volume 54. On the side opposite the intermediate element 48, the compression area 52 is bounded by a piston 56 which, in an exemplary case, is arranged in a fixed position. The piston 56 is part of a cylinder/piston arrangement, with the cavity in this cylinder/piston arrangement being formed by the compression area 52.

The piston 56 has a flow opening for the first contact 14. A seal 80 is inserted into a circumferential groove in the piston, between the piston 56 and the first contact 14, in order to seal a gap between the first contact 14 and the piston 56. Furthermore, the seal 80 also forms a guide for the first contact 14. The piston 56 is sealed with respect to the separating element 30 by means of a further seal 82, which is inserted into a further circumferential groove in the piston 56.

On the side of the piston 56 opposite the compression area 52, there is an exhaust volume 58 within the conductor element 33. This exhaust volume 58 is connected to the arc zone 40 by means of a flow channel 59, which is formed in the tube 12, such that quenching gas which flows from the heating area 46 through the gas channel 44 into the arc zone 40 can flow away through the flow channel 59 into the exhaust volume 58. During a high-current phase, quenching gas can also flow directly out of the arc zone 40 into the exhaust volume 58.

A channel 60 passes through the intermediate element 48 from the compression area 52 into the heating area 46 and can be closed by an intermediate valve 62, which is in the form of a non-return valve, such that quenching gas flows from the compression area 52 into the heating area 46 when the pressure in the compression area 52 is higher than that in the heating area 46. When the pressure in the heating area 46 is higher than that in the compression area 52, the intermediate valve 62 closes.

A flow opening 64' leads in the radial direction from the compression area 52 into a low-pressure area 72 which is radially externally adjacent to the separating element 30. The low-pressure area 72 surrounds the rated-current contact arrangement. The gas pressure in the low-pressure area 72 is at least approximately constant during a switching process of the gas-blast circuit breaker 10, and is, for example, in the range from 3-7 bar.

As shown in FIG. 6, the flow opening 64' cannot be closed by a valve. In other words, the flow opening is a flow opening 64' which cannot be closed and through which quenching gas can flow out and flow in. The flow opening 64' which cannot be closed passes through the separating element 30 in the radial direction with respect to the longitudinal axis A. In consequence, a flow direction through the flow opening 64' which cannot be closed also runs in the radial direction. The quenching gas flow through the flow opening 64' which cannot be closed can be controlled by the unobstructed diameter of the flow opening 64', for example, when the pressure in the compression area 52 is higher than that in the low-pressure area 72. In consequence, particularly during disconnection of the first contact 14 from the second contact 18, and with the volume of the compression area 52 being reduced at the same time, quenching gas can flow away from the compression area 52 into the low-pressure area 72 through the flow opening 64' which cannot be closed.

As shown in FIG. 6, a flow opening 64 which forms a purging aperture 66 can be arranged in parallel with the flow opening 64' which cannot be closed. This flow opening 64 once again connects the low-pressure area 72 to the blowout volume 54, for example, to the compression area 52. The purging aperture 66 can be closed by means of a purging valve 74, which is in the form of a non-return valve, such that the purging valve 74 opens when the pressure in the compression area 52 is lower than in the low-pressure area 72, and otherwise closes.

The low-pressure area 72 is bounded by a casing, which is not shown, of the gas-blast circuit breaker, and is connected to the exhaust volume 58 via a gas return.

A plurality of purging apertures 66 may, of course, also be provided, each of which can be closed by means of a purging valve 74. A plurality of flow openings 64' which cannot be closed can likewise be provided.

The gas-blast circuit breaker illustrated in FIG. 6 operates, for example, as follows during opening of the gas-blast circuit breaker. First of all, the rated-current contact arrangement is opened. The contact arrangement which is formed by the first contact 14 and the second contact 18 is then disconnected, as a result of which an arc is struck in the arc zone 40, because of the current flowing through the contact arrangement. Quenching gas is thus heated. This initially flows through the gas channel 44 into the heating area 46. When the contact arrangement opens, the movement of the separating element 30 together with the first contact 40 in the direction of the longitudinal axis A away from the second contact 18 at the same time reduces the volume of the compression area 52, as a result of which the gas pressure in it rises. When the gas pressure in the compression area 52 becomes greater than that in the heating area 46, the intermediate valve 62 opens, as a result of which quenching gas flows into the heating area 46 through the channel 60 from the compression area 52, and further increases the gas pressure in the heating area 46. As soon as the gas pressure in the arc zone 40 decreases, the quenching gas flows out of the heating area 46 through the gas channel 44 into the arc zone 40, and blows out the arc, which is thus quenched.

However, if the gas pressure in the heating area 46 rises rapidly to a high value because of a high current flow, initiated, for example, by a ground fault, the situation can occur in which the intermediate valve 62 remains closed in the heating area 46 during the disconnection process of the contact arrangement, or at least is closed over a relatively long time period during the disconnection process. The quenching gas therefore cannot flow away from the compression area 52 into the heating area 46, but the quenching gas can flow away into the low-pressure area 72 through the flow opening 64' which cannot be closed. In this situation the pressure in the compression area 52 is higher than that in the low-pressure area 72, and the pressure in the heating area 46 is higher than that in the compression area 52. Since the gas pressure in the low-pressure area 72 is at least virtually constant, for example, during the disconnection process, the maximum pressure in the compression area 52 can be defined by the unobstructed diameter of the flow opening 64' which cannot be closed. This makes it possible to ensure that the force required to open the contact arrangement, for example, to move the separating element 30 together with the first contact 14 into the conductor element 33, does not exceed a maximum force. The drive arrangement can therefore be designed such that the contact arrangement can be reliably disconnected even when a high current is flowing.

The quenching gas which is used to blow out the arc in the arc zone 40 flows away from the heating area 46 through the gas channel 44 to the arc zone 40, and then flows away on the one hand through the flow channel 59 into the exhaust volume 58 and on the other hand through the nozzle opening 36. The hot quenching gas is cooled in the exhaust volume 58. A gas exchange can take place between the exhaust volume 58 and the low-pressure area 72 via a gas return, which is not shown.

When the contact arrangement closes, the volume of the compression area 52 increases which results in the pressure in the compression area 52 being lower than that in the low-pressure area 72 and in the heating area 46.

In consequence on the one hand, quenching gas flows into the compression area 52 through the flow opening 64' which cannot be closed. In addition, the purging valve 74 is opened, and releases the purging aperture 66 for the quenching gas to flow into the compression area 52 from the low-pressure area 72. As soon as the gas pressure in the compression volume 52 rises above the gas pressure in the low-pressure area 72, the purging valve 74 closes.

Figure 7:
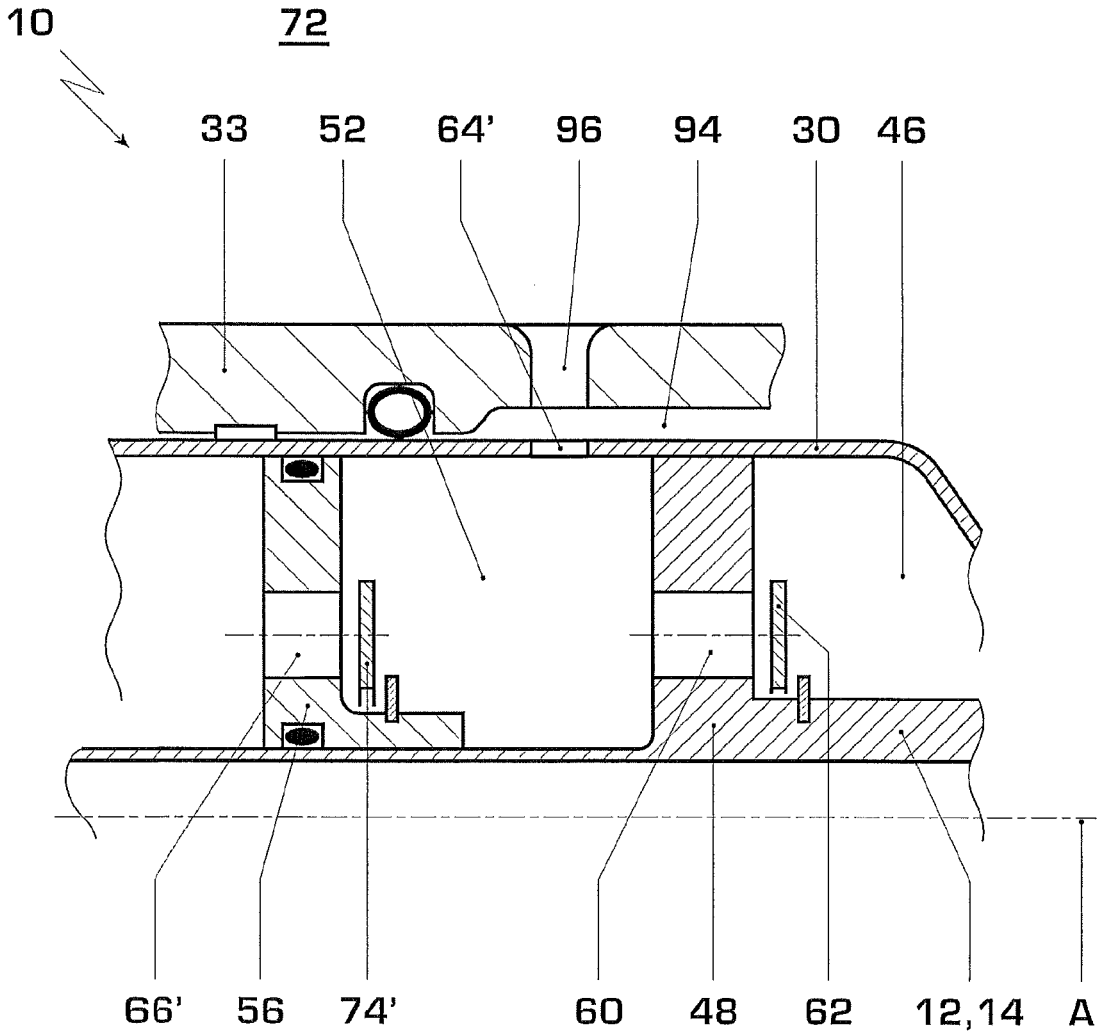
FIG. 7 shows an exemplary gas-blast circuit breaker according to the disclosure which has an axially arranged purging valve and a flow opening which is arranged radially and cannot be closed.

FIG. 7 shows a further exemplary embodiment of the gas-blast circuit breaker. This exemplary embodiment corresponds essentially to the gas-blast circuit breaker 10 illustrated in FIG. 6. Only the differences will be described here.

In this embodiment, the separating element 30 has only the flow opening 64' which cannot be closed. For example, between 4 and 8 flow openings 64' which cannot be closed are formed on the separating element 30. The flow openings 64' which cannot be closed may also be in the form of slots.

The intermediate element 48 shown in FIG. 7 is formed integrally with the tube 12 of the first contact 14. The intermediate piece and the tube 12 may, of course, also be formed from a plurality of individual elements.

The piston 56 has a purging aperture 66' which, in a corresponding manner to the purging aperture 66 described in conjunction with FIG. 6, can be closed by means of a purging valve 74' which is in the form of a non-return valve. The purging aperture 66' leads from the exhaust volume 58 into the compression area 52.

The channel 60 passes through the intermediate element 48, which is arranged on the first contact 14, in the direction of the longitudinal axis A. The intermediate element 48 has, for example, a plurality of channels 60 which are arranged regularly in the circumferential direction. The channel 60 or the channels 60 can be closed by means of a valve plate of the intermediate valve 62. The valve plate is, for example, once again in the form of a circular annular disk.

In comparison to the exemplary embodiment shown in FIG. 1, the conductor element 33 can be longer in the direction of the longitudinal axis A. An intermediate area 94 is formed between the separating element 30 and the lengthened section of the separating element 30. The flow opening 64' which cannot be closed opens into this intermediate area 94. A channel 96 leads from the intermediate area 94 into the low-pressure area 72.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Gas-blast circuit breaker
12 Tube
14 First contact
16 Pin
18 Second contact
20 Free end
30 Separating element
32 End area
33 Conductor element
34 Nozzle body
35 Contact spring
36 Nozzle opening
38 Nozzle channel
40 Arc zone
44 Gas channel
46 Heating area
48 Intermediate element
52 Compression area
54 Blowout volume
56 Piston
58 Exhaust volume
59 Flow channel
60 Channel
62 Intermediate valve
64 Flow opening
64' Flow opening which cannot be closed
66, 66' Purging aperture
68 Overpressure aperture
72 Low-pressure area
74, 74' Purging valve
76 Overpressure valve
80, 82 Seal
86 Annular channel
87 Connecting channel
88 Wall
90 Annular disk
92 Springs
94 Intermediate area
96 Channel
98 Dual-acting valve
100 Holes
102 Guide element
104 Valve plate
106, 108 Shafts
A Longitudinal axis

What is claimed is:

1. A gas-blast circuit breaker comprising:

a first contact;

a second contact for making an electrically conductive connection to the first contact, with the first contact being movable relative to the second contact along a longitudinal axis;

a blowout volume including a compression area, which is connected to an arc zone for receiving a pressure build-up and for blowing out an arc with quenching gas;

a cylinder-piston arrangement in the compression area of the blowout volume;

an exhaust volume for receiving and cooling gas;

a low-pressure area, which is separated by a separating element from the blowout volume and in which gas pressure is maintained approximately constant during a switching process; and a plurality of parallel flow openings formed in the separating element, at least one of which cannot be closed, for providing a gas exchange between the low-pressure area and the compression area of the blowout volume through an area of the separating element which separates the compression area of the blowout volume from the low-pressure area in a radial direction with respect to the longitudinal axis.

2. The gas-blast circuit breaker as claimed in claim 1, wherein a flow direction through the flow opening runs essentially in the radial direction.

3. The gas-blast circuit breaker as claimed in claim 1, comprising:

an intermediate element arranged in the blowout volume for subdividing the blowout volume into a heating area which is directly connected to the arc zone, and the compression area, with the flow opening into the compression area.

4. The gas-blast circuit breaker as claimed in claim 1, comprising:

a further flow opening which can be closed and including a purging valve formed as a non-return valve which opens when gas pressure on a low-pressure area of the further flow opening is higher.

5. The gas-blast circuit breaker as claimed in claim 1, wherein the separating element is movable during opening and during closing of the electrically conductive connection.

6. The gas-blast circuit breaker as claimed in claim 1, wherein the flow opening opens directly into the low-pressure area.

7. The gas-blast circuit breaker as claimed in claim 3, comprising:

a first channel formed between the compression area and the heating area for gas flow from the compression area into the heating area; and an intermediate valve formed as a non-return valve for closing the first channel when pressure in the heating area is higher than pressure in the compression volume.

8. The gas-blast circuit breaker as claimed in claim 7, wherein the flow opening is a first flow opening, the circuit breaker comprising:

a second flow opening formed as a connecting channel, with the connecting channel and the first channel being formed in a common assembly, and a valve for closing the connecting channel and a valve for closing the first channel.

9. The gas-blast circuit breaker as claimed in claim 8, wherein the flow opening and first channel are arranged in a common assembly.

10. The gas-blast circuit breaker as claimed in claim 1, wherein the exhaust volume is adjacent in the longitudinal direction to the blowout volume on a side of the gas-blast circuit opposite the arc zone, and wherein the piston of the cylinder-piston arrangement for separates the blowout volume in a sealed manner from the exhaust volume, and wherein the separating element is formed by the cylinder of the cylinder-piston arrangement.

11. The gas-blast circuit breaker as claimed in claim 1, wherein the exhaust volume is connected to the low-pressure area via a gas return.

12. The gas-blast circuit breaker as claimed in claim 1, wherein the low-pressure area is arranged radially outside the blowout volume with respect to the longitudinal axis of the gas-blast circuit breaker.

13. The gas-blast circuit breaker as claimed in claim 3, wherein at least one of flow openings comprising:

a purging aperture formed between the compression area and the exhaust volume; and a purging valve formed as a non-return valve for closing the purging aperture when pressure in the compression area is higher than pressure in the exhaust volume.

14. A gas-blast circuit breaker comprising:

a first contact;

a second contact for making an electrically conductive connection to the first contact, with the first contact and the second contact being movable relative to one another along a longitudinal axis;

a blowout volume including a compression area, which is connected to an arc zone for receiving a pressure build-up and for blowing out an arc with quenching gas;

a cylinder-piston arrangement in the compression area of the blowout volume;

an exhaust volume for receiving and cooling gas;

a low-pressure area, which is separated by a separating element from the blowout volume and in which gas pressure is maintained approximately constant during a switching process;

a plurality of parallel flow openings formed in the separating element for providing a gas exchange between the low-pressure area and the compression area of the blowout volume though an area of the separating element which separates the compression area of the blowout volume from the low-pressure area in a radial direction with respect to the longitudinal axis, wherein one of the flow openings is a purging valve formed as a non-return valve arranged in or on the flow opening, which purging valve is formed as a non-return valve, which opens when the pressure in the compression area is lower than the pressure in the low-pressure area and which otherwise is closed.

15. The gas-blast circuit breaker as claimed in claim 14, wherein the purging valve is open when gas pressure is higher on a low-pressure area side of the flow opening.

16. The gas-blast circuit breaker as claimed in claim 14, wherein the purging valve and an overpressure valve are arranged as a dual-acting valve in or on the flow opening.

17. The gas-blast circuit breaker as claimed in claim 14, comprising:

a further flow opening; and an overpressure valve arranged in or on the further flow opening for opening at a defined reduced pressure on a low-pressure area side of the further flow opening.

18. The gas-blast circuit breaker as claimed in claim 17, wherein the overpressure valve and/or the purging valve are/ is arranged in the radial direction between the separating element and the longitudinal axis of the gas-blast circuit breaker.

19. The gas-blast circuit breaker as claimed in claim 14, comprising:

an intermediate element arranged in the blowout volume for subdividing the blowout volume into a heating area which is connected directly to the arc zone, and the compression area, wherein the flow opening opens into the compression area.

20. The gas-blast circuit breaker as claimed in claim 17, comprising:

an intermediate element arranged in the blowout volume for subdividing the blowout volume into a heating area which is directly connected to the arc zone, and the compression area, with the flow opening opens into the compression area.

21. The gas-blast circuit breaker as claimed in claim 14, wherein the separating element is movable during opening and during closing of the electrically conductive connection.

22. The gas-blast circuit breaker as claimed in claim 14, wherein the flow opening opens directly into the low-pressure area.

23. The gas-blast circuit breaker as claimed in claim 20, comprising:

a first channel formed between the compression area and the heating area for gas flow from the compression area into the heating area; and an intermediate valve formed as a non-return valve for closing the first channel when pressure in the heating area is higher than pressure in the compression volume.

24. The gas-blast circuit breaker as claimed in claim 23, wherein the flow opening is formed as a connecting channel, with the connecting channel and the first channel being formed in a common assembly, the gas blast circuit breaker comprising:

a valve for closing the connecting channel and a valve for closing the first channel.

25. The gas-blast circuit breaker as claimed in claim 14, wherein the exhaust volume is adjacent in the longitudinal direction to the blowout volume on a side of the gas-blast circuit opposite the arc zone, and wherein the piston of the cylinder-piston arrangement separates the blowout volume in a sealed manner from the exhaust volume, and wherein the separating element is formed by the cylinder of the cylinder-piston arrangement.

26. The gas-blast circuit breaker as claimed in claim 14, wherein the exhaust volume is connected to the low-pressure area via a gas return.

27. The gas-blast circuit breaker as claimed in claim 14, wherein the low-pressure area is arranged radially outside the blowout volume with respect to the longitudinal axis of the gas-blast circuit breaker.

* * * * *